US012655742B1

(12) United States Patent
Marica

(10) Patent No.: US 12,655,742 B1
(45) Date of Patent: Jun. 16, 2026

(54) AUTOMATED TRIPPING OPERATION USING DATA ACQUISITION DEVICE WITH ENCODERS FOR PERFORMING MULTI-DIMENSIONAL DATA ACQUISITION IN A WELL SYSTEM

(71) Applicant: Halliburton Energy Services, Inc., Houston, TX (US)

(72) Inventor: Adrian Marica, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/092,625

(22) Filed: Mar. 27, 2025

(51) Int. Cl.
*E21B 44/00* (2006.01)
*E21B 19/15* (2006.01)

(52) U.S. Cl.
CPC ..... *E21B 44/00* (2013.01); *E21B 19/15* (2013.01)

(58) Field of Classification Search
CPC ..... E21B 44/00; E21B 19/15
See application file for complete search history.

(56) References Cited

U.S. PATENT DOCUMENTS

| | | | | |
|---|---|---|---|---|
| 11,069,082 | B1 | 7/2021 | Ebrahimi et al. | |
| 11,906,290 | B2 | 2/2024 | Binder | |
| 2006/0096754 | A1* | 5/2006 | Weightmann | E21B 19/22 166/77.3 |
| 2011/0203803 | A1* | 8/2011 | Zemlak | E21B 19/002 166/349 |
| 2017/0138181 | A1 | 5/2017 | Ross et al. | |
| 2019/0071941 | A1 | 3/2019 | Dobkins et al. | |
| 2021/0189810 | A1 | 6/2021 | Magnuson | |
| 2022/0145710 | A1* | 5/2022 | Saunders | E21B 44/00 |

FOREIGN PATENT DOCUMENTS

| | | | |
|---|---|---|---|
| CN | 108343428 | A | 7/2018 |
| CN | 107914265 | B | 8/2021 |
| CN | 111993159 | B | 2/2022 |
| WO | 2014007790 | A1 | 1/2014 |

OTHER PUBLICATIONS

International Patent Application No. PCT/US2025/024696, International Search Report and Written Opinion mailed Dec. 19, 2025, 11 pages.

* cited by examiner

*Primary Examiner* — Yanick A Akaragwe
(74) *Attorney, Agent, or Firm* — Kilpatrick Townsend & Stockton LLP

(57) ABSTRACT

A system can be used to facilitate an automated tripping operation. The system can include a tubular and a subsystem. The tubular can be positioned in a wellbore. The subsystem, such as a data acquisition device, can be coupled with the tubular to track a linear displacement of the tubular in the wellbore for controlling the automated tripping operation in the wellbore. The subsystem can include a set of rollers and a set of encoders. The set of rollers can be positioned in rotational contact with the tubular. The set of encoders can be positioned adjacent to the tubular to provide multi-dimensional information about the tubular in the wellbore.

18 Claims, 6 Drawing Sheets

AUTOMATED TRIPPING OPERATION USING DATA ACQUISITION DEVICE WITH ENCODERS FOR PERFORMING MULTI-DIMENSIONAL DATA ACQUISITION IN A WELL SYSTEM

TECHNICAL FIELD

The present disclosure relates generally to wellbore operations and, more particularly (although not necessarily exclusively), to an automated tripping operation that can be performed in a well system using a subsystem, such as a data acquisition device, that can include a set of encoders that can be used to perform multi-dimensional or continuous data acquisition.

BACKGROUND

Wellbore operations may include various equipment, components, methods, or techniques to perform various tasks, such as positioning components, with respect to a wellbore. In some examples, the wellbore operations may involve positioning a subsystem, such as a hydraulic workover subsystem, a coiled tubing subsystem, a well tool thereof, etc., in a wellbore or remove it from the wellbore. It may be difficult to track multiple different measurements or data points about the subsystem while the subsystem, or well tool thereof, is being positioned in the wellbore or is being removed from the wellbore.

DETAILED DESCRIPTION

Figure 1:
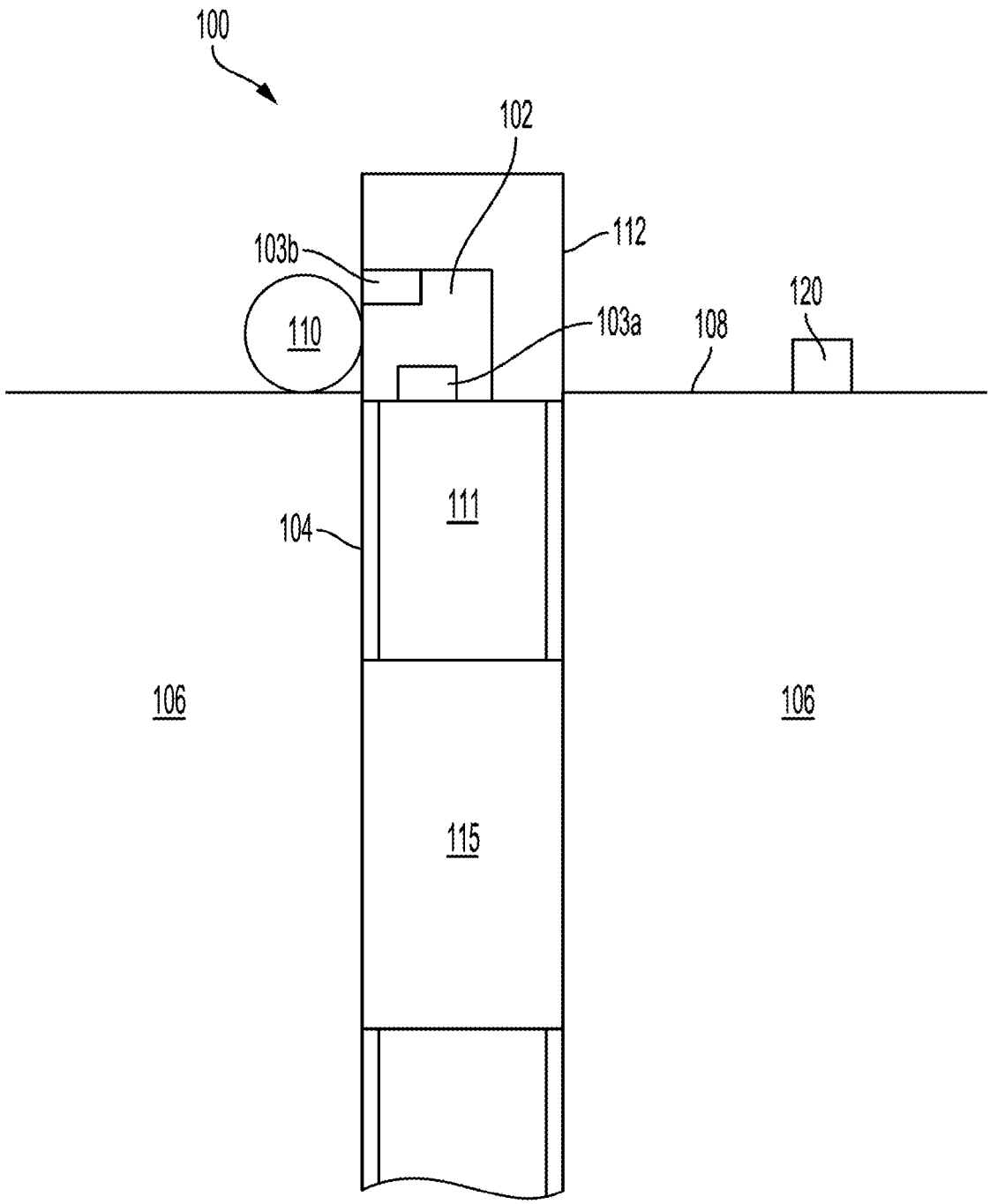
FIG. 1 is a diagram of a well system that can include a subsystem, such as a data acquisition device, with encoders to facilitate an automated tripping operation according to some aspects of the present disclosure.

Certain aspects and examples of the present disclosure relate to a subsystem, such as a data acquisition device, that can include encoders for performing multi-dimensional data acquisition for an automated tripping operation in a wellbore. The subsystem can be positioned in, on, or otherwise with respect to a well system that includes the wellbore, and the wellbore may be formed in a subterranean formation or a suboceanic formation for extracting material such as hydrocarbon material, water, brine, or the like. A tripping operation can involve positioning one or more subsystems, or well tools thereof, into the wellbore, can involve removing the one or more subsystems, or the well tools thereof, from the wellbore, can involve repositioning the one or more subsystems, or the well tools thereof, within the wellbore, or any combination thereof. An automated tripping operation can involve a tripping operation for positioning, such as positioning in or within, removing from, etc., the one or more subsystems, or the well tools thereof, with respect to the wellbore without manual intervention. The automated tripping operation may use multi-dimensional data to control certain aspects, such as speed, depth, etc., of the automated tripping operation. In some examples, the multi-dimensional data can include results of data acquisition relating to a diameter of a tubular, such as a pipe, of the one or more subsystems, a displacement of the one or more subsystems or the tubular, a distance in a particular direction of the one or more subsystems or the tubular, other suitable multi-dimensional data of the one or more subsystems or tubular, or any combination thereof. The subsystem that can include the encoders can be positioned on a tubular of a system that is positioned with respect to the wellbore using the automated tripping operation. In some examples, the encoders may be or include sensors that can make measurements or otherwise facilitate data acquisition in multiple dimensions. For example, the encoders can track a diameter of the tubular and a position, such as a displacement or distance and direction, of the tubular in the wellbore such as during the automated tripping operation.

A tripping operation, such as an operation involving a hydraulic workover, can involve adjusting a location of a system in a wellbore based on a diameter of a tubular of the system, based on a length of the tubular, based on a diameter of a tubular joint, such as a pipe joint, of the system, based on reference distances to the foregoing as the tubular is translated in the wellbore, or any combination thereof. In some examples, a reference distance can be or include a stroke length of a jack, an instantaneous length between a traveling bowl and a fixed bowl, an instantaneous length between the fixed bowl and a blowout preventer, or other suitable distances. Additionally or alternatively, in order to open a slip bowl, the tubular may be translated in an opposite direction with respect to a direction of the tripping operation. The distance may be measured to accurately predict where a joint will end, which may not be into a slip bowl or a blowout preventer. Moreover, tubulars of various lengths may be used in a tubular string and many combinations can be possible. The tubulars to be used in a tubular string may be tabulated and tracked. Other systems and techniques may not tabulate or track the tubulars or may do so manually: operators measure, record, and track the tubulars and their order in a string to be tripped in or out. The other systems and techniques are difficult or impossible to use to facilitate a tripping operation with minimal or no errors or accidents.

A subsystem, such as the subsystem with encoders disclosed herein, can be used to facilitate an automated tripping operation in the wellbore. The subsystem can include a claw-type shape or other suitable shape, and the subsystem can include a set of encoders for making measurements, or otherwise facilitating data acquisition, about the tubular. In some examples, the subsystem can include at least one body incorporating at least one encoder in which the body can be contacted by some means against the tubular to be measured. A linear displacement transducer can be attached to the body of the subsystem, which can incorporate at least one encoder associated with a wheel in contact with the tubular to be measured. In some examples, other encoders can be associated with a pivoting joint of the claw-shape of the subsystem or otherwise attached to a linear-to-rotary motions converting mechanism when the body is pushed against the tubular.

In some examples, the subsystem can automatically measure a diameter of the tubular, a traveled length or displacement of the tubular as the tubular travels in linear motion and in contact with the device, or a combination thereof. The subsystem can identify and electronically record a presence of tubulars or joints in the string. Using these parameters as inputs into controlling algorithms can allow prediction of a location of a joint within the section between the travelling slip bowls and blowout preventers. The section can additionally include a fixed slip bowl or other pieces of equipment. Determining the location of the joint, for example within the section, can allow for generating a continuously evolving picture or image of the string as it travels within the section. The image can be displayed on a monitoring device to facilitate one or more decisions about the automated tripping operation or can be used as input to a control algorithm for controlling the automated tripping operation. In some examples, the subsystem can generate electronic records of length of tripping of the tubular, of length of tripping of constituent elements of the tubular, or any combination thereof.

In some examples, such as examples in which the subsystem has an approximate claw-like shape, the subsystem can include a set of rollers, a set of shafts, a set of claw arms, a tubular, a spring, an electromagnet, one or more cylinders, a set of encoders, other suitable components, or any combination thereof. Each roller of the set of rollers can be coupled with a corresponding shaft of the set of shafts, which may be coupled with or integrated with a corresponding claw arm. The corresponding claw arm can be clamped around the tubular using the spring, though the electromagnet or the one or more cylinders can augment, or replace, the spring to enhance functionality or structural integrity of the subsystem. The set of rollers may be retained in contact with the tubular to facilitate at least a portion of the data acquisition associated with the subsystem. In some examples, one or more encoders of the set of encoders can be adapted to a joint of the claw arm, and the one or more encoders can be affixed to one arm of the joint. The shaft may be affixed to another arm of the joint to allow relative movement between the body and the shaft. The relative movement can indicate rotation in the joint, and the rotation can be proportional with respect to a diameter of the tubular.

In some examples, the set of rollers of the subsystem can be in permanent contact with the tubular. A shaft of a second encoder of the set of encoders can be affixed to an outer race of a roller of the set of rollers, while a body of the shaft can be affixed to a housing of the subsystem. The roller can rotate while staying in contact with the tubular. As the roller rotates, a shaft of the second encoder can also rotate to generate relative motion, such as relative rotation, between the shaft and the body. The second encoder can indicate a signal proportional to travel or displacement of the tubular, a signal proportional to a change in diameter of the tubular, or a combination thereof. A length of the tubular can be determined from a proportional relationship between the signal from the encoder and the length of travel of the tubular upstream or downstream. Additionally or alternatively, the diameter of the tubular can be determined from the proportional relationship between the signal from the encoder and variations in the diameter of the tubular. In some examples, each encoder of the set of encoders, or any subset thereof, can include non-contact magnetic encoders or other suitable types of encoders.

In some examples, such as in examples in which the subsystem has shapes or arrangements not including claw-like shapes or arrangements, the subsystem can include a set of rollers that can be affixed to a corresponding set of shafts in corresponding housings. The rollers can be retained in contact with a tubular associated with the subsystem such as by electromagnetic actuators, air or hydraulic cylinders, etc. A follower can be affixed to one end of a shaft while a magnet of a non-contact encoder can be affixed to an opposite end of the shaft. A body can be slidingly attached to the housing, and a follower can be translated along a spiraled shaft attached to the encoder. The set of rollers can continuously follow a diameter of the tubular, and a change in diameter can cause the follower to translate along the spiraled shaft to also rotate the encoder. The length of the tubular can be measured by the set of rollers running along the tubular and the encoder generating a proportional signal such as a first signal. A change in the diameter of the tubular can be measured by the follower running along the spiraled shaft and causing the encoder to generate a proportional signal such as a second signal. The first signal and the second signal can be monitored or input into a control module for controlling the automated tripping operation.

In some examples, the rollers can be substituted with, or augmented by, inductive linear displacement transducers or inductive displacement sensors. To reduce friction and shaft bending, a roller can be adapted at a contact point between the sensor's shaft and the tubular. This way, the friction can be converted into rolling motion while preserving a function of the sensor. Additionally or alternatively, an articulated arm with a fixed joint or articulation at one end and a roller at the opposite end can be used. Inside the roller, an encoder can be positioned along the arm, and perpendicular to the encoder can be an inductive displacement sensor. The sensor can measure tubular travel by counting the number of rotations of the encoder and can measure, such as directly measure, any diameter changes by the displacement sensor. In some examples, the sensor can be used to measure an ovality of the tubular. An ovality of the tubular can indicate a deviation of a cross-section of the tubular from a perfect circle, can be a measured value based on a comparison between a cross-section of the tubular and a circle, etc.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure. As used herein, approximately indicates that a recited value may vary, such as above or below, by 1%, 2%, 3%, 4%, 5%, from 5% to 10%, from 10% to 20%, and the like.

FIG. 1 is a diagram of a well system 100 that can include a subsystem 102, such as a data acquisition device, with encoders to facilitate an automated tripping operation according to some aspects of the present disclosure. As illustrated in FIG. 1, the well system 100 can include a wellbore 104 formed in a formation 106, which may be or include a subterranean formation, a suboceanic formation, or other suitable formations. At a surface 108 of the wellbore 104, a tripping device 110 may be positioned to allow a string 111 to be lowered into the wellbore 104, to be removed from the wellbore 104, to be repositioned in the wellbore 104, or any combination thereof. In some examples, the string 111 can include or be positioned through a hydraulic workover unit 112 that can be positioned at the surface 108 of the wellbore 104, or in other suitable locations, to perform or otherwise facilitate one or more wellbore operations. For example, the string 111 can include a well tool 115, such as one or more sensors, a drill bit, etc., that can facilitate a wellbore operation in the wellbore 104. The hydraulic workover unit 112 can include the subsystem 102 that can include set of encoders, though a coiled tubing unit that includes the subsystem 102 that includes the set of encoders can be used in place of the hydraulic workover unit 112 to facilitate the one or more wellbore operations. In some examples, the one or more wellbore operations can include an automatic tripping operation for positioning the well tool 115, or other suitable tools or components, in the wellbore 104, removing the well tool 115, or the other suitable tools or components, from the wellbore 104, etc.

As illustrated in FIG. 1, the hydraulic workover unit 112 can include the subsystem 102. The subsystem 102 can include a measurement subsystem or other suitable subsystem that can facilitate multi-dimensional data acquisition in the well system 100. In some examples, the subsystem 102 can include a set of encoders that can include a first encoder 103*a*, a second encoder 103*b*. While two encoders are illustrated in FIG. 1, other suitable numbers, such as less than two or more than two, of encoders are possible to include in the subsystem 102. A number of encoders included in the subsystem 102 can be determined or selected based on intended results for multi-dimensional data acquisition for controlling the automated tripping operation. For example, the set of encoders can be positioned within the subsystem 102 to facilitate multi-dimensional data acquisition about the subsystem 102, about the wellbore 104, about the string 111, about the well tool 115, or about any other portion of the well system 100, for example to facilitate the automatic tripping operation. In some examples, the set of encoders can be replaced with, or augmented by, a set of linear transducers that can facilitate the multi-dimensional data acquisition.

Each encoder of the set of encoders can be positioned at a different component of a set of components of the subsystem 102. In some examples, more than one encoder of the set of encoders may be positioned at a particular component of the set of components. The number of encoders positioned at the particular component may be determined based on data intended to be acquired using encoders at the particular component. For example, one or more first encoders of the set of encoders can be positioned at an intersection point between shafts extending from a set of rollers of the subsystem 102 to provide a first type of data via first multi-dimensional acquisition involving the subsystem 102, one or more second encoders of the set of encoders can be positioned adjacent the set of rollers of the subsystem 102 to provide a second type of data via second multi-dimensional data acquisition involving the subsystem 102, and so on.

The multi-dimensional data acquisition provided by the set of encoders can be used to control or otherwise facilitate an automated tripping operation. For example, results of the multi-dimensional data acquisition can be performed using the set of encoders and can be provided to a control unit 120 of the well system 100 for determining a speed of tripping, a length of tripping, a direction of tripping, or other suitable parameters of tripping. Additionally or alternatively, the results can be provided to the control unit 120 to determine whether an emergency stop is to be performed, whether a suitable displacement has been achieved for positioning the well tool 115 in the wellbore 104, etc. The results can be provided to the control unit 120, or to any other unit or device, for controlling or facilitating the automatic tripping operation.

Figure 2:
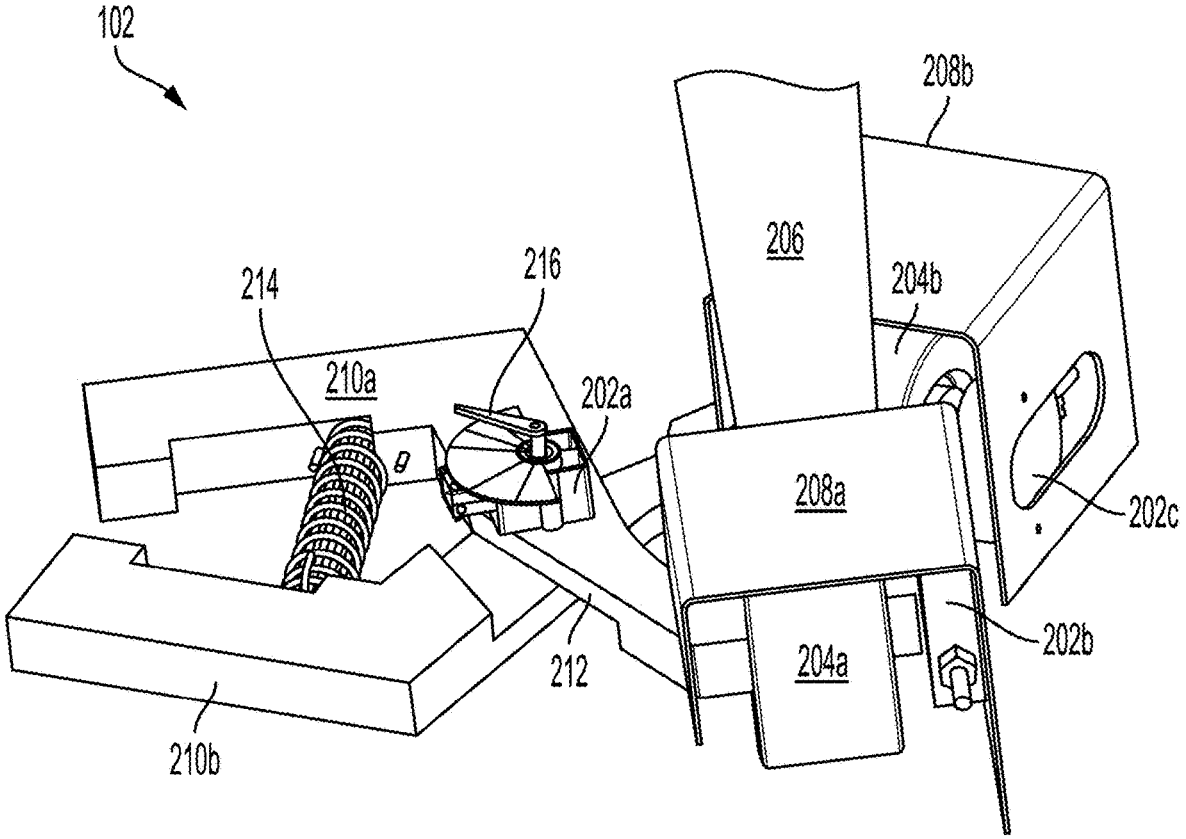
FIG. 2 is a diagram of a first arrangement of a subsystem, such as a data acquisition device, with rollers and encoders that can be used to provide multi-dimensional information to facilitate an automated tripping operation according to some aspects of the present disclosure.

FIG. 2 is a diagram of a first arrangement of a subsystem 102, such as a data acquisition device, with rollers and encoders that can be used to provide multi-dimensional information to facilitate an automated tripping operation according to some aspects of the present disclosure. In some examples, the subsystem 102 can be or include a data acquisition subsystem that can be used to perform data acquisition for providing multi-dimensional information for an automated tripping operation. As illustrated in FIG. 2, the subsystem 102 can include a set of transducers that can be or include a set of encoders, which may include a first encoder 202*a*, a second encoder 202*b*, and a third encoder 202*c*, and a set of rollers, which may include a first roller 204*a* and a second roller 204*b*. The set of encoders can include any other suitable number, such as less than three or more than three, of encoders, and the set of rollers can include any other suitable number, such as less than two or more than two, of rollers, to facilitate multi-dimensional data acquisition by the subsystem 102.

In some examples, the subsystem 102 can include a tubular 206. In some examples, the tubular 206 can be or include a pipe or pipe string, though other suitable tubulars are possible to include or be associated with the subsystem 102. The tubular 206 can be positioned in a wellbore via translation, such as by tripping, of the tubular 206 through the subsystem 102. The first roller 204*a* and the second roller 204*b* can be positioned adjacent to the tubular 206. In some examples, the first roller 204*a*, the second roller 204*b*, or a combination thereof can be positioned to be in rotational contact with the tubular 206 to allow tracking of the tubular 206 as the tubular 206 is tripped into or out of the wellbore. For example, and as the tubular 206 is translated, the first roller 204*a*, the second roller 204*b*, or a combination thereof can rotate, and the second encoder 202*b*, the third encoder 202*c*, or a combination thereof can facilitate a data acquisition involving the tubular 206, the first roller 204*a*, and the second roller 204*b*.

In some examples, the second encoder 202*b* can be positioned adjacent to, or proximate to and offset from, the first roller 204*a* within a first housing 208*a*. Additionally or alternatively, the third encoder 202*c* can be adjacent to, or proximate to and offset from, the second roller 204*b* within a second housing 208*b*. The first housing 208*a* may be positioned on a first side of the tubular 206 to cause the first roller 204*a* to be positioned on the first side of the tubular 206, and the second housing 208*b* may be positioned on a second side of the tubular 206 to cause the second roller 204*b* to be positioned on the second side of the tubular 206. In some examples, the first side of the tubular 206 can be opposite the second side of the tubular 206 with respect to a central axis of the tubular 206. In other examples, the first side may be a different, but not opposite, side of the tubular 206 compared to the second side.

In some examples, the subsystem 102 can additionally include a first shaft 210*a* and a second shaft 210*b*. The first shaft 210*a*, the second shaft 210*b*, or a combination thereof can be or include an angled shaft that may extend in an initial direction in a straight line and then bend into one or more different directions depending on a use case intended for the respective shaft. The first shaft 210*a* may extend from the first roller 204*a*, and the second shaft 210*b* may extend from the second roller 204*b*, though a vice versa arrangement is possible. The first shaft 210*a* may cross over the second shaft 210*b* at a first location 212 that may be offset from the first roller 204*a* and the second roller 204*b*. The first shaft 210*a* and the second shaft 210*b* may be hingedly coupled at the first location 212 to allow the first shaft 210*a* and the second shaft 210*b* to move with respect to one another. As illustrated in FIG. 2, the first shaft 210*a* and the second shaft 210*b* may be coupled to form a claw-like shape, though other suitable shapes are possible.

In some examples, the first shaft 210*a* and the second shaft 210*b* may be further coupled by a spring 214 or other coupling means such as an electromagnet, one or more cylinders, and the like. The spring 214 can cause a biasing force to be applied to the first shaft 210*a* and the second shaft 210*b* for facilitating data acquisition by the first encoder 202*a*, which may be positioned at the first location 212. For example, if a diameter of the tubular 206 changes, the first roller 204*a*, the second roller 204*b*, or a combination thereof may move away from a central axis of the tubular 206, and the movement may cause a corresponding movement in the first shaft 210*a*, in the second shaft 210*b*, or in a combination thereof. The spring 214 may resist, but allow, the corresponding movement, and the first encoder 202*a* can measure a change in an angle 216 between the first shaft 210*a* and the second shaft 210*b*. The angle 216 may be proportional to, or may otherwise be used to determine, a change in diameter of the tubular 206, or an instantaneous value thereof.

Figure 3:
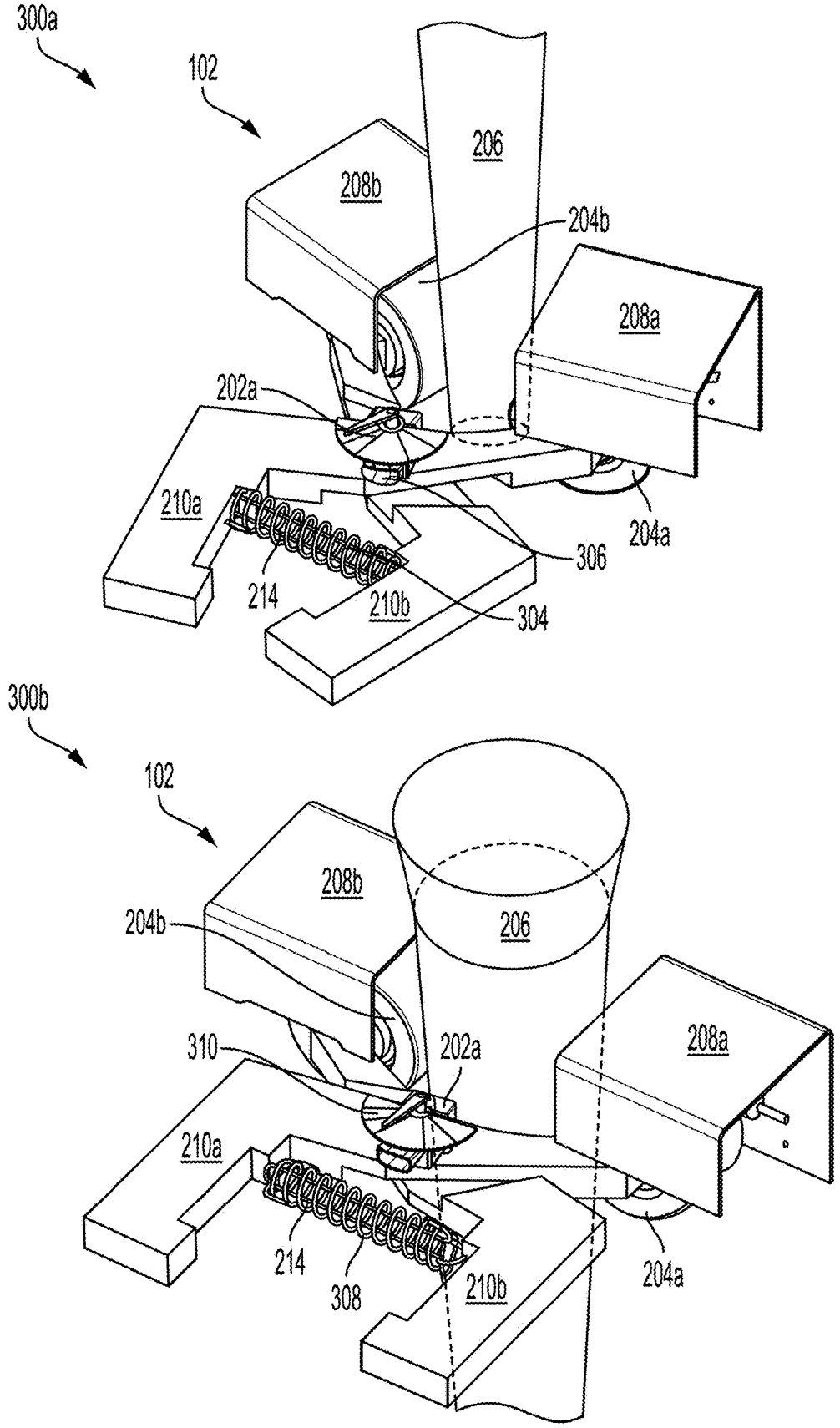
FIG. 3 is a set of perspective views of a first arrangement of a subsystem, such as a data acquisition device, with rollers and encoders that can be used to provide multi-dimensional information to facilitate an automated tripping operation according to some aspects of the present disclosure.

FIG. 3 is a set of perspective views 300*a-b* of a first arrangement of a subsystem 102 with rollers and encoders that can be used to provide multi-dimensional information to facilitate an automated tripping operation according to some aspects of the present disclosure. As illustrated in FIG. 3, a first perspective view 300*a* of the subsystem 102 represents the subsystem 102 at a first time of the automated tripping operation, and a second perspective view 300*b* of the subsystem 102 represents the subsystem 102 at a second time of the automated tripping operation. The subsystem 102 can be in, or include, the first arrangement of the subsystem 102 that has a claw-like shape, though other arrangements or shapes are possible for the subsystem 102.

As illustrated in the first perspective view 300*a*, the subsystem 102 can include the first encoder 202*a*, the first roller 204*a* positioned within the first housing 208*a*, the second roller 204*b* positioned within the second housing 208*b*, the first shaft 210*a* extending from the first roller 204*a*, and the second shaft 210*b* extending from the second roller 204*b*. The first shaft 210*a* can be coupled with the second shaft 210*b* at the first location 212, and a spring 214, or other suitable coupling means, can extend from the first shaft 210*a* to the second shaft 210*b*. At a first time of the automated tripping operation, the spring 214 may have a first length 304 that can correspond with a diameter of the tubular 206. For example, the first length 304 of the spring 214 may correspond with a first angle 306 between the first shaft 210*a* and the second shaft 210*b* as determined by using the first encoder 202*a*. The first angle 306 can be used to determine the diameter of the tubular 206, to determine an instantaneous change of the diameter of the tubular 206, or a combination thereof.

As illustrated in the second perspective view 300*b*, the subsystem 102 can include the first encoder 202*a*, the first roller 204*a* positioned within the first housing 208*a*, the second roller 204*b* positioned within the second housing 208*b*, the first shaft 210*a* extending from the first roller 204*a*, and the second shaft 210*b* extending from the second roller 204*b*. The first shaft 210*a* can be coupled with the second shaft 210*b* at the first location 212, and the spring 214, or other suitable coupling means, can extend from the first shaft 210*a* to the second shaft 210*b*. At a second time of the automated tripping operation in which the tubular 206 has been tripped further into or out of the wellbore, the spring 214 may have a second length 308 that can correspond with a diameter of the tubular 206. For example, the second length 308 of the spring 214 may correspond with a second angle 310 between the first shaft 210*a* and the second shaft 210*b* as determined by using the first encoder 202*a*. The second angle 310 can be used to determine the diameter of the tubular 206, to determine an instantaneous change of the diameter of the tubular 206, or a combination thereof.

Figure 4:
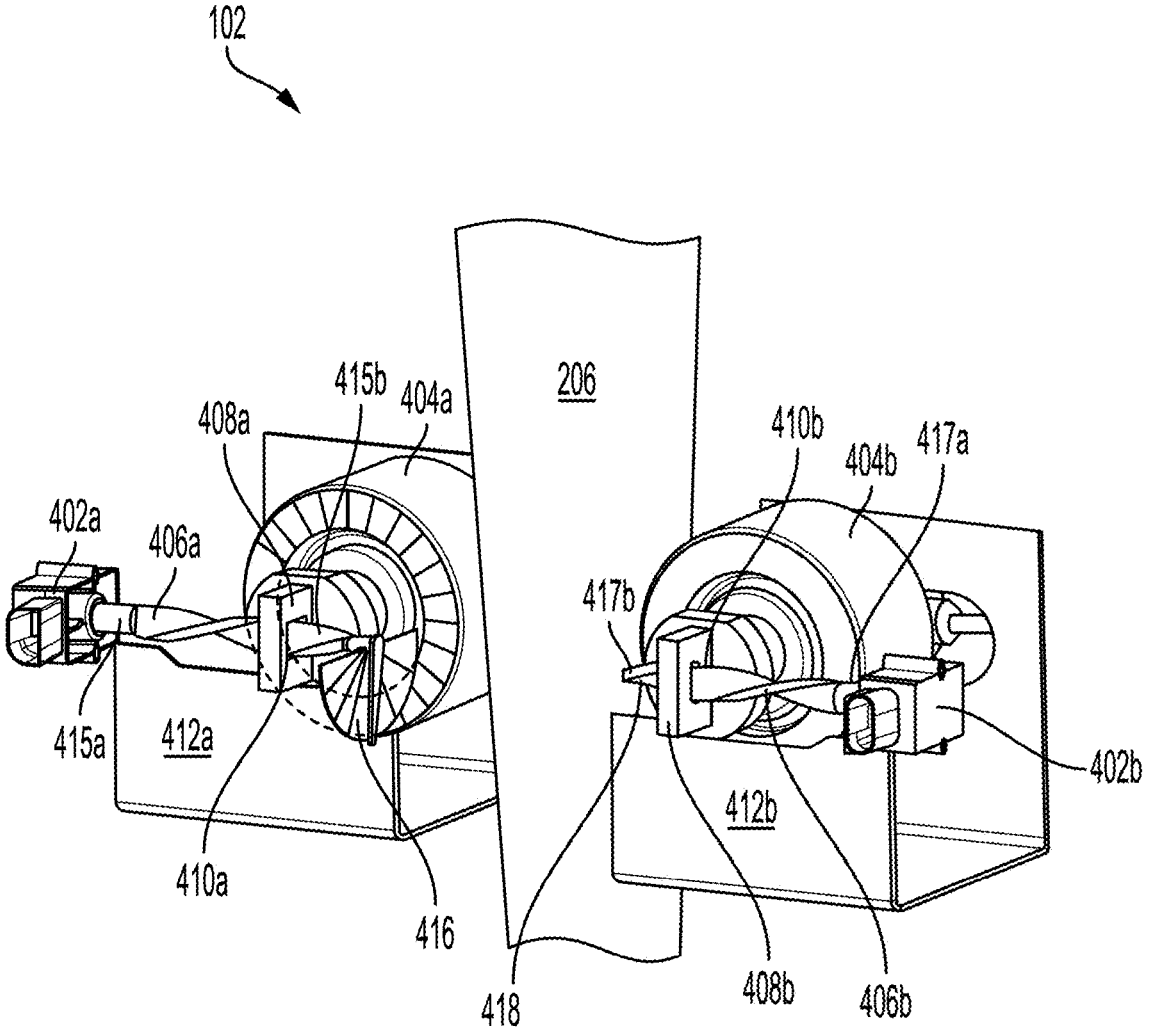
FIG. 4 is a diagram of a second arrangement of a subsystem, such as a data acquisition device, with rollers and encoders that can be used to provide multi-dimensional information to facilitate an automated tripping operation according to some aspects of the present disclosure.

FIG. 4 is a diagram of a second arrangement of a subsystem 102 with rollers and encoders that can be used to provide multi-dimensional information to facilitate an automated tripping operation according to some aspects of the present disclosure. As illustrated in FIG. 4, the subsystem 102 can include a set of encoders, which may include a first encoder 402*a*, a second encoder 402*b*, a third encoder, and a fourth encoder, and a set of rollers, which may include a first roller 404*a* and a second roller 404*b*. The set of encoders can include any other suitable number, such as less than four or more than four, of encoders, and the set of rollers can include any other suitable number, such as less than two or more than two, of rollers, to facilitate multi-dimensional data acquisition by the subsystem 102.

In some examples, the subsystem 102 can include a tubular 206. The tubular 206 can be positioned in a wellbore via translation, such as by tripping, of the tubular 206 through the subsystem 102. The first roller 404*a* and the second roller 404*b* can be positioned adjacent to the tubular 206. For example, the first roller 404*a* can be positioned on a first side of the tubular 206, and the second roller 404*b* can be positioned on a second side of the tubular 206 that is opposite with respect to, or otherwise different from, the first side. In some examples, the first roller 404*a*, the second roller 404*b*, or a combination thereof can be positioned to be in rotational contact with the tubular 206 to allow tracking of the tubular 206 as the tubular 206 is tripped into or out of the wellbore. For example, and as the tubular 206 is translated, the first roller 404*a*, the second roller 404*b*, or a combination thereof can rotate, and one or more encoders of the set of encoders included in the subsystem 102 can facilitate a data acquisition involving the tubular 206, the first roller 404*a*, and the second roller 404*b*.

In some examples, the subsystem 102 can additionally include a set of spiraled shafts. As illustrated in FIG. 4, the subsystem 102 can include a first spiraled shaft 406*a* and a second spiraled shaft 406*b*, though other suitable numbers of spiraled shafts, such as less than two or more than two, can be included in the subsystem 102. The first spiraled shaft 406*a* can be coupled with a first follower 408*a* that can be positioned in the first roller 404*a*. The first follower 408*a* can include a first opening 410*a* sized to receive at least a section of the first spiraled shaft 406*a*. In some examples, the first spiraled shaft 406*a* may be secured to a first housing 412*a*, and the first spiraled shaft 406*a* may be rotated about a longitudinal axis thereof based on a position of the first roller 404*a*. For example, in response to tripping the tubular 206 and the first roller 404*a* contacting an increasingly larger diameter of the tubular 206, the first follower 408*a* can be translated and can cause the first spiraled shaft 406*a* to rotate. A rotation of the first spiraled shaft 406*a* can be tracked by the first encoder 402*a*, which may be positioned on or at a first end 415*a* of the first spiraled shaft 406*a*. The first follower 408*a* may be positioned at least initially at a second end 415*b* of the first spiraled shaft 406*a*. The first encoder 402*a* can perform a data acquisition that can include determining a first angle 416 of the first spiraled shaft 406*a*, and the first angle 416 can be used to determine a diameter of the tubular 206, an instantaneous change thereof, etc.

The second spiraled shaft 406*b* can be coupled with a second follower 408*b* that can be positioned in the second roller 404*b*. The second follower 408*b* can include a second opening 410*b* sized to receive at least a section of the second spiraled shaft 406*b*. In some examples, the second spiraled shaft 406*b* may be secured to a second housing 412*b*, and the second spiraled shaft 406*b* may be rotated about a longitudinal axis thereof based on a position of the second roller 404*b*. For example, in response to tripping the tubular 206 and the second roller 404*b* contacting an increasingly larger diameter of the tubular 206, the second follower 408*b* can be translated and can cause the second spiraled shaft 406*b* to rotate. A rotation of the second spiraled shaft 406*b* can be tracked by the second encoder 402*b*, which may be positioned on or at a first end 417*a* of the second spiraled shaft 406*b*. The second follower 408*b* may be positioned at least initially at a second end 417*b* of the second spiraled shaft 406*b*. The second encoder 402*b* can perform a data acquisition that can include determining a second angle 418 of the second spiraled shaft 406*b*, and the second angle 418 can be used to determine a diameter of the tubular 206, an instantaneous change thereof, etc.

Figure 5:
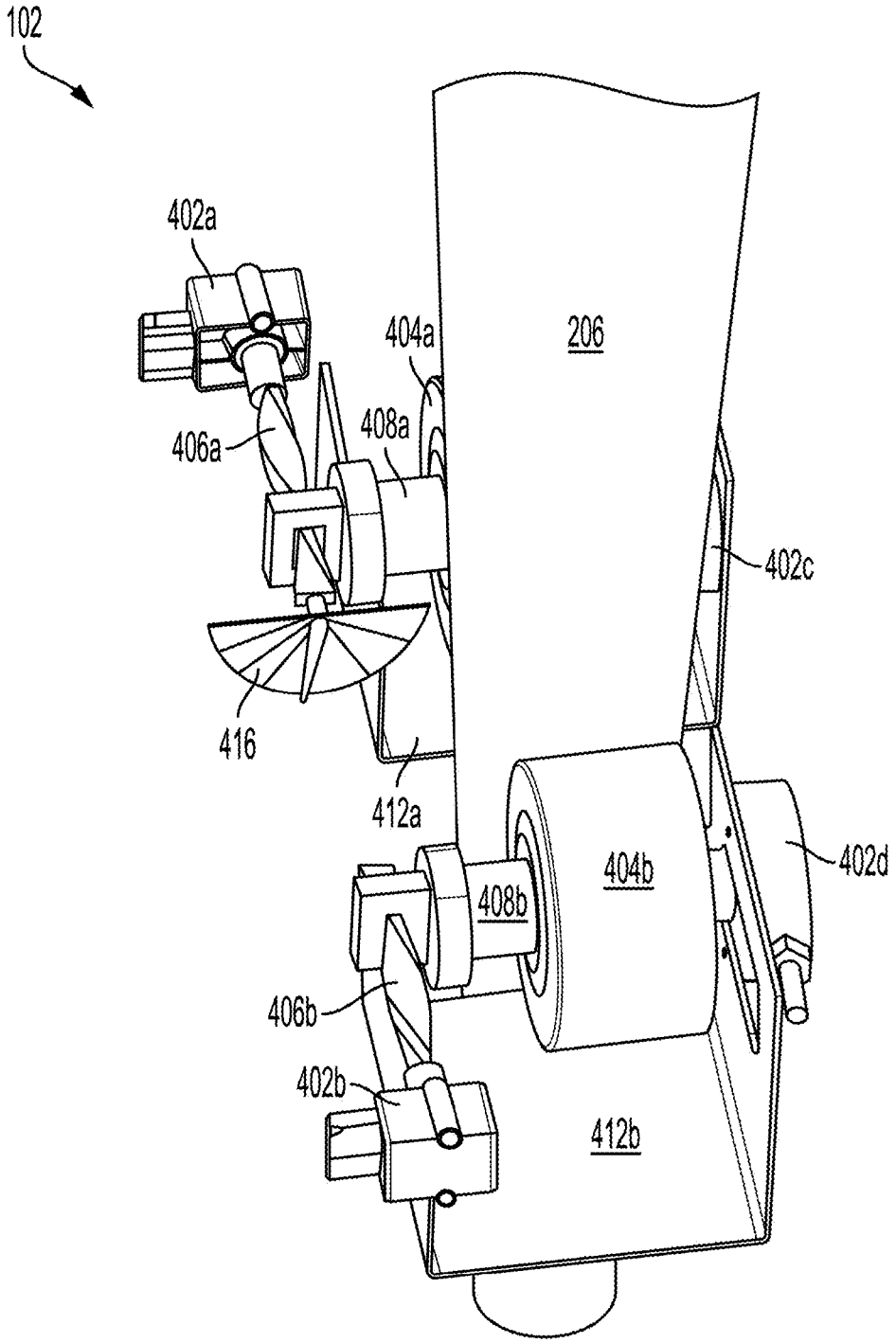
FIG. 5 is a perspective view of a second arrangement of a subsystem, such as a data acquisition device, with rollers and encoders that can be used to provide multi-dimensional information to facilitate an automated tripping operation according to some aspects of the present disclosure.

FIG. 5 is a perspective view of a second arrangement of a subsystem 102 with rollers and encoders that can be used to provide multi-dimensional information to facilitate an automated tripping operation according to some aspects of the present disclosure. As illustrated in FIG. 5, the subsystem 102 can include the set of encoders that can include the first encoder 402*a*, the second encoder 402*b*, a third encoder 402*c*, and a fourth encoder 402*d*, though other numbers of encoders, such as less than four or more than four, are possible to include in the subsystem 102. The first encoder 402*a* can be positioned on the first spiraled shaft 406*a* to facilitate at least a first data acquisition related to the tubular 206. Additionally or alternatively, the second encoder 402*b* can be positioned on the second spiraled shaft 406*b* to facilitate at least a second data acquisition related to the tubular 206. The first data acquisition and the second data acquisition may be combined to generate an output such as a data point related to a diameter of the tubular 206, an instantaneous change thereof, etc., which may be based on an angle, such as the first angle 416, determined using data from the first encoder 402*a*.

In some examples, the third encoder 402*c* can be positioned adjacent to the first roller 404*a*, and the fourth encoder 402*d* can be positioned adjacent to the second roller 404*b*, though a vice versa arrangement is possible. Additionally or alternatively, the third encoder 402*c* and the fourth encoder 402*d* may be offset from the first roller 404*a* and the second roller 404*b*, respectively, to facilitate one or more data acquisitions with respect to the tubular 206. As illustrated in FIG. 4, the first roller 404*a* may be positioned in the first housing 412*a*, and the second roller 404*b* may be positioned in the second housing 412*b*. The third encoder 402*c* may be positioned on an outside of the first housing 412*a* offset from, but arranged to perform data acquisition with respect to, the first roller 404*a*. Additionally or alternatively, the fourth encoder 402*d* may be positioned on an outside of the second housing 412*b* offset from, but arranged to perform data acquisition with respect to, the second roller 404*b*.

In some examples, the third encoder 402*c* may be arranged to perform data acquisition about a rotation of the first roller 404*a*, and the fourth encoder 402*d* may be arranged to perform data acquisition about a rotation of the second roller 404*b*. The data acquisitions performed by the third encoder 402*c* and the fourth encoder 402*d* may involve determining a total rotation of a respective roller and using the total rotation to determine a length that the tubular 206 has been tripped, a speed of tripping of the tubular 206, other suitable linear measurements relating to the tubular 206, or any combination thereof.

In some examples, the third encoder 402*c* of the set of encoders can be located adjacent to the first roller 404*a* to determine a first linear displacement of the tubular 206. Additionally or alternatively, the fourth encoder 402*d* of the set of encoders can be located adjacent to the second roller 404*b* to determine a second linear displacement of the tubular 206. The first linear displacement and the second linear displacement can be used to determine an ovality of the tubular 206.

In some examples, the data acquisition performed using the set of encoders included in the subsystem 102 may be multi-dimensional. Multi-dimensional data acquisition can include measurements, or other gathered data, of different parameters of a common target, can include different instances, or locations, of data of common parameters of a common target, etc. For example, the third encoder 402*c* can be used to perform multi-dimensional data acquisition by itself since the third encoder 402*c* can be arranged in the subsystem 102 to measure, or acquire data about, multiple different parameters of the tubular 206. The multiple different parameters of the tubular 206 can include a linear displacement, a direction of linear displacement, etc. Additionally or alternatively, the third encoder 402*c*, in combination with the fourth encoder 402*d*, can be used to perform multi-dimensional data acquisition since the third encoder 402*c* and the fourth encoder 402*d* can make measurements of, or acquire data relating to, common parameters of the tubular 206 at different locations. The common parameters can include a linear displacement, a direction of linear displacement, etc.

Figure 6:
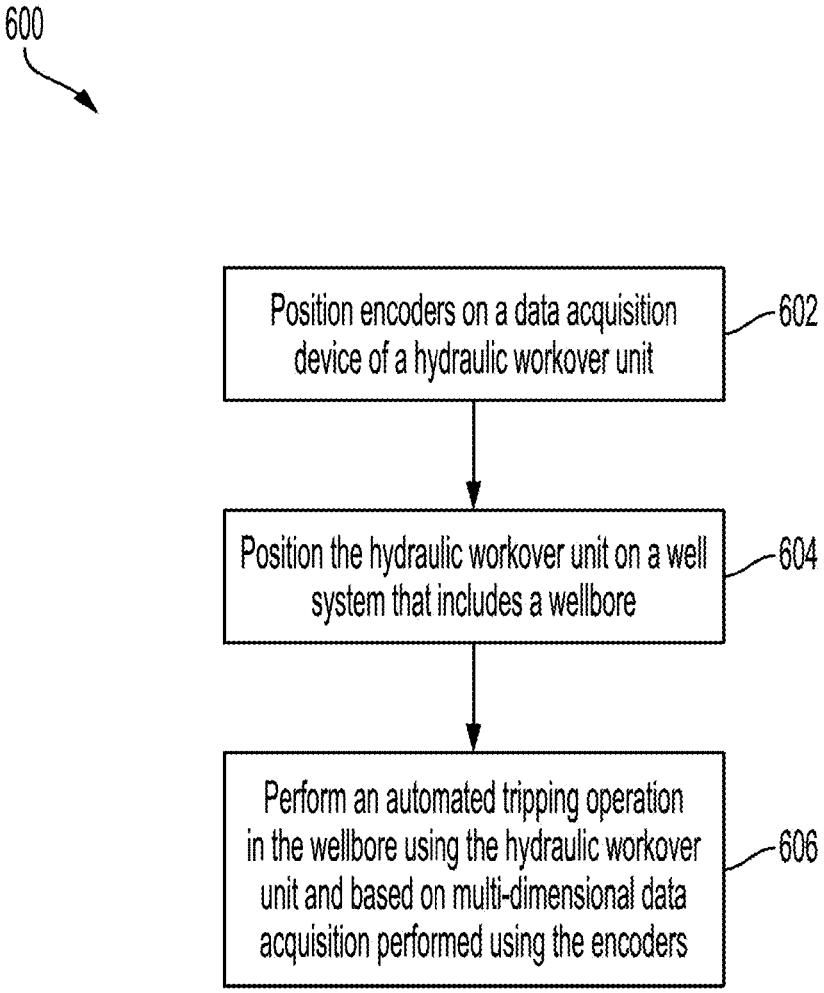
FIG. 6 is a flowchart of a process for performing multi-dimensional data acquisition with respect to a subsystem, such as a data acquisition device, for automating a tripping operation in a wellbore according to some aspects of the present disclosure.

FIG. 6 is a flowchart of a process 600 for performing multi-dimensional data acquisition with respect to a subsystem 102 for automating a tripping operation in a wellbore 104 according to some aspects of the present disclosure. At block 602, a set of encoders is positioned on the subsystem 102 such as on a data acquisition device. The set of encoders can include at least one encoder for each subcomponent of the subsystem 102, though more or fewer encoders is possible to include in the subsystem 102. For example, at least one encoder can be positioned in the subsystem 102 to measure a linear displacement and direction of the tubular 206, at least another encoder can be positioned in the subsystem 102 to measure a diameter of the tubular 206, and so on. The subsystem 102 may be included in a hydraulic workover unit, though the subsystem 102 may be positioned in a coiled tubing unit, other suitable systems or units, or any combination thereof in addition to, or alternative to, the hydraulic workover unit.

At block 604, the hydraulic workover unit that includes the subsystem 102 is positioned on a well system 100 that includes a wellbore 104. In some examples, the subsystem 102 can be positioned at a surface 108 of the wellbore 104 or the well system 100 such as above the wellbore 104, though other suitable locations for the subsystem 102 are possible. The subsystem 102 can be positioned on the well system 100 to facilitate one or more wellbore operations, which may include the automated tripping operation, with respect to the wellbore 104.

At block 606, an automated tripping operation is performed using the subsystem 102. In some examples, the automated tripping operation can be performed to automatically position a well tool 115, or other suitable item or device, in the wellbore 104, remove the well tool 115, or other suitable item or device, from the wellbore 104, or to otherwise reposition the well tool 115, or other suitable item or device, with respect to the wellbore 104. The automated tripping operation can be performed using input gathered from the set of encoders of the subsystem 102 and may be able to proceed with minimal, or zero, interventions. The input gathered from the set of encoders can include results from multi-dimensional data acquisition about the subsystem 102 or about a tubular 206 or other component thereof. For example, the input gathered using the set of encoders can include a diameter of the tubular 206, or an instantaneous change thereof, a linear displacement, and a direction thereof, of the tubular 206, etc. The input can be provided to a control unit that can change control parameters for the automated tripping operation. In some examples, the control parameters can include a direction of displacement, a length of displacement, a speed of displacement, whether to stop the operation for maintenance or repair, etc.

In some aspects, systems, data acquisition subsystems, and methods for an automated tripping operation using a subsystem with encoders for providing multi-dimensional information are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a tubular positionable in a wellbore; and a subsystem couplable with the tubular to track a linear displacement of the tubular in the wellbore for controlling an automated tripping operation in the wellbore, the subsystem comprising: a set of rollers positionable in rotational contact with the tubular; and a set of encoders that is positionable to be adjacent to the tubular to provide multi-dimensional information about the tubular in the wellbore.

Example 2 is the system of example 1, wherein a first roller of the set of rollers is located on a first side of the tubular, wherein a second roller of the set of rollers is located on a second side of the tubular opposite the first side, and wherein a first encoder of the set of encoders is arranged to measure first rotation of the first roller or second rotation of the second roller to determine a magnitude and direction of movement of the tubular.

Example 3 is the system of example 2, wherein the first encoder of the set of encoders is located adjacent to the first roller to determine a first linear displacement of the tubular, wherein a second encoder of the set of encoders is located adjacent to the second roller to determine a second linear displacement of the tubular, and wherein the first linear displacement and the second linear displacement are usable to determine an ovality of the tubular.

Example 4 is the system of example 2, further comprising a set of shafts, wherein a first shaft of the set of shafts extends from the first roller, wherein a second shaft of the set of shafts extends from the second roller, and wherein the first shaft and the second shaft are coupled with a spring to facilitate data acquisition about a diameter of the tubular.

Example 5 is the system of example 4, wherein the first shaft and the second shaft overlap at a first location, wherein a second encoder of the set of encoders is located at the first location to track an angle between the first shaft and the second shaft, and wherein the angle between the first shaft and the second shaft is proportional to the diameter of the tubular.

Example 6 is the system of example 2, further comprising a set of followers, wherein a first follower of the set of followers extends out of the first roller in a first direction, wherein a second follower of the set of followers extends out of the second roller in a second direction that is approximately the same as the first direction, and wherein the set of followers are arranged to translate linearly in a third direction approximately parallel to the first direction and the second direction independent of rotational motion of the set of followers.

Example 7 is the system of example 6, further comprising a set of spiraled shafts, wherein the set of encoders further comprises a second encoder and a third encoder, wherein the second encoder is located on a first end of a first spiraled shaft of the set of spiraled shafts, wherein the third encoder is located on a first end of a second spiraled shaft of the set of spiraled shafts, wherein the first follower is located at a second end of the first spiraled shaft to facilitate a first data acquisition by the second encoder about a diameter of the tubular, and wherein the second follower is located at a second end of the second spiraled shaft to facilitate a second data acquisition by the third encoder about the diameter of the tubular.

Example 8 is a data acquisition subsystem comprising: a set of rollers positionable in rotational contact with a tubular positionable in a wellbore via an automated tripping operation; and a set of transducers that is positionable to be adjacent to track linear displacement of the tubular and to provide multi-dimensional information about the tubular in the wellbore for controlling the automated tripping operation.

Example 9 is the data acquisition subsystem of example 8, wherein the set of transducers comprises a set of encoders, wherein a first roller of the set of rollers is located on a first side of the tubular, wherein a second roller of the set of rollers is located on a second side of the tubular opposite the first side, and wherein a first encoder of the set of encoders is arranged to measure first rotation of the first roller or second rotation of the second roller to determine a magnitude and direction of movement of the tubular.

Example 10 is the data acquisition subsystem of example 9, wherein the first encoder of the set of encoders is located adjacent to the first roller to determine a first linear displacement of the tubular, wherein a second encoder of the set of encoders is located adjacent to the second roller to determine a second linear displacement of the tubular, and wherein the first linear displacement and the second linear displacement are usable to determine an ovality of the tubular.

Example 11 is the data acquisition subsystem of example 9, further comprising a set of shafts, wherein a first shaft of the set of shafts extends from the first roller, wherein a second shaft of the set of shafts extends from the second roller, and wherein the first shaft and the second shaft are coupled with a spring to facilitate data acquisition about a diameter of the tubular.

Example 12 is the data acquisition subsystem of example 11, wherein the first shaft and the second shaft overlap at a first location, wherein a second encoder of the set of encoders is located at the first location to track an angle between the first shaft and the second shaft, and wherein the angle between the first shaft and the second shaft is proportional to the diameter of the tubular.

Example 13 is the data acquisition subsystem of example 9, further comprising a set of followers, wherein a first follower of the set of followers extends out of the first roller in a first direction, wherein a second follower of the set of followers extends out of the second roller in a second direction that is approximately the same as the first direction, and wherein the set of followers are arranged to translate linearly in a third direction approximately parallel to the first direction and the second direction independent of rotational motion of the set of followers.

Example 14 is the data acquisition subsystem of example 13, further comprising a set of spiraled shafts, wherein the set of encoders further comprises a second encoder and a third encoder, wherein the second encoder is located on a first end of a first spiraled shaft of the set of spiraled shafts, wherein the third encoder is located on a first end of a second spiraled shaft of the set of spiraled shafts, wherein the first follower is located at a second end of the first spiraled shaft to facilitate a first data acquisition by the second encoder about a diameter of the tubular, and wherein the second follower is located at a second end of the second spiraled shaft to facilitate a second data acquisition by the third encoder about the diameter of the tubular.

Example 15 is a method comprising: positioning a set of encoders on a subsystem of a hydraulic workover unit, the set of encoders positioned among a set of rollers of the subsystem and adjacent to a tubular associated with the hydraulic workover unit; positioning the hydraulic workover unit on a well system that includes a wellbore; and performing an automated tripping operation with respect to the wellbore using the subsystem, the automated tripping operation involving performing multi-dimensional data acquisition about the subsystem using the set of encoders to determine linear displacement and multi-dimensional information of the tubular for controlling the automated tripping operation.

Example 16 is the method of example 15, wherein a first roller of the set of rollers is located on a first side of the tubular, wherein a second roller of the set of rollers is located on a second side of the tubular opposite the first side, and wherein performing the automated tripping operation comprises using a first encoder of the set of encoders to acquire data about first rotation of the first roller or second rotation of the second roller to determine a magnitude and direction of movement of the tubular.

Example 17 is the method of example 16, wherein performing the automated tripping operation comprises: using the first encoder of the set of encoders to determine a first linear displacement of the tubular; and using a second encoder of the set of encoders to determine a second linear displacement of the tubular, wherein the first linear displacement and the second linear displacement are used to determine an ovality of the tubular.

Example 18 is the method of example 16, wherein the subsystem comprises a set of shafts, wherein a first shaft of the set of shafts extends from the first roller, wherein a second shaft of the set of shafts extends from the second roller, wherein the first shaft and the second shaft are coupled with a spring to facilitate data acquisition about a diameter of the tubular, wherein the first shaft and the second shaft overlap at a first location, wherein a second encoder of the set of encoders is located at the first location to track an angle between the first shaft and the second shaft, and wherein the angle between the first shaft and the second shaft is proportional to the diameter of the tubular.

Example 19 is the method of example 16, wherein the subsystem comprises a set of followers, wherein a first follower of the set of followers extends out of the first roller in a first direction, wherein a second follower of the set of followers extends out of the second roller in a second direction that is approximately the same as the first direction, and wherein performing the automated tripping operation comprises linearly translating the set of followers in a third direction approximately parallel to the first direction and the second direction independent of rotational motion of the set of followers.

Example 20 is the method of example 19, wherein the subsystem comprises a set of spiraled shafts, wherein the set of encoders includes a second encoder and a third encoder, wherein the second encoder is located on a first end of a first spiraled shaft of the set of spiraled shafts, wherein the third encoder is located on a first end of a second spiraled shaft of the set of spiraled shafts, and wherein performing the automated tripping operation comprises: performing a first data acquisition by the second encoder about a diameter of the tubular; and performing a second data acquisition by the third encoder about the diameter of the tubular.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a tubular positionable in a wellbore;

a subsystem couplable with the tubular to track a linear displacement of the tubular in the wellbore for controlling an automated tripping operation in the wellbore, the subsystem comprising:

a set of rollers positionable in rotational contact with the tubular; and a set of encoders that is positionable to be adjacent to the tubular to provide multi-dimensional information about the tubular in the wellbore;

a first shaft extending from a first roller of the set of rollers; and a second shaft extending from a second roller of the set of rollers, the first shaft and the second shaft configured to be coupled with a spring to facilitate data acquisition about a diameter of the tubular.

2. The system of claim 1, wherein the first roller of the set of rollers is located on a first side of the tubular, wherein the second roller of the set of rollers is located on a second side of the tubular opposite the first side, and wherein a first encoder of the set of encoders is arranged to measure first rotation of the first roller or second rotation of the second roller to determine a magnitude and direction of movement of the tubular.

3. The system of claim 2, wherein the first encoder of the set of encoders is located adjacent to the first roller to determine a first linear displacement of the tubular, wherein a second encoder of the set of encoders is located adjacent to the second roller to determine a second linear displacement of the tubular, and wherein the first linear displacement and the second linear displacement are usable to determine an ovality of the tubular.

4. The system of claim 2, wherein the first shaft and the second shaft overlap at a first location, wherein a second encoder of the set of encoders is located at the first location to track an angle between the first shaft and the second shaft, and wherein the angle between the first shaft and the second shaft is proportional to the diameter of the tubular.

5. The system of claim 2, further comprising a set of followers, wherein a first follower of the set of followers extends out of the first roller in a first direction, wherein a second follower of the set of followers extends out of the second roller in a second direction that is approximately the same as the first direction, and wherein the set of followers are arranged to translate linearly in a third direction approximately parallel to the first direction and the second direction independent of rotational motion of the set of followers.

6. The system of claim 5, further comprising a set of spiraled shafts, wherein the set of encoders further comprises a second encoder and a third encoder, wherein the second encoder is located on a first end of a first spiraled shaft of the set of spiraled shafts, wherein the third encoder is located on a first end of a second spiraled shaft of the set of spiraled shafts, wherein the first follower is located at a second end of the first spiraled shaft to facilitate a first data acquisition by the second encoder about a diameter of the tubular, and wherein the second follower is located at a second end of the second spiraled shaft to facilitate a second data acquisition by the third encoder about the diameter of the tubular.

7. A data acquisition subsystem comprising:

a set of rollers positionable in rotational contact with a tubular positionable in a wellbore via an automated tripping operation;

a set of transducers that is positionable to be adjacent to the tubular to track linear displacement of the tubular and to provide multi-dimensional information about the tubular in the wellbore for controlling the automated tripping operation;

a first shaft extending from a first roller of the set of rollers; and a second shaft extending from a second roller of the set of rollers, the first shaft and the second shaft configured to be coupled with a spring to facilitate data acquisition about a diameter of the tubular.

8. The data acquisition subsystem of claim 7, wherein the set of transducers comprises a set of encoders, wherein the first roller of the set of rollers is located on a first side of the tubular, wherein the second roller of the set of rollers is located on a second side of the tubular opposite the first side, and wherein a first encoder of the set of encoders is arranged to measure first rotation of the first roller or second rotation of the second roller to determine a magnitude and direction of movement of the tubular.

9. The data acquisition subsystem of claim 8, wherein the first encoder of the set of encoders is located adjacent to the first roller to determine a first linear displacement of the tubular, wherein a second encoder of the set of encoders is located adjacent to the second roller to determine a second linear displacement of the tubular, and wherein the first linear displacement and the second linear displacement are usable to determine an ovality of the tubular.

10. The data acquisition subsystem of claim 8, wherein the first shaft and the second shaft overlap at a first location, wherein a second encoder of the set of encoders is located at the first location to track an angle between the first shaft and the second shaft, and wherein the angle between the first shaft and the second shaft is proportional to the diameter of the tubular.

11. The data acquisition subsystem of claim 8, further comprising a set of followers, wherein a first follower of the set of followers extends out of the first roller in a first direction, wherein a second follower of the set of followers extends out of the second roller in a second direction that is approximately the same as the first direction, and wherein the set of followers are arranged to translate linearly in a third direction approximately parallel to the first direction and the second direction independent of rotational motion of the set of followers.

12. The data acquisition subsystem of claim 11, further comprising a set of spiraled shafts, wherein the set of encoders further comprises a second encoder and a third encoder, wherein the second encoder is located on a first end of a first spiraled shaft of the set of spiraled shafts, wherein the third encoder is located on a first end of a second spiraled shaft of the set of spiraled shafts, wherein the first follower is located at a second end of the first spiraled shaft to facilitate a first data acquisition by the second encoder about a diameter of the tubular, and wherein the second follower is located at a second end of the second spiraled shaft to facilitate a second data acquisition by the third encoder about the diameter of the tubular.

13. A method comprising:

positioning a set of encoders on a subsystem of a hydraulic workover unit, the set of encoders positioned among a set of rollers of the subsystem and adjacent to a tubular associated with the hydraulic workover unit, the subsystem comprising:

a first shaft extending from a first roller of a set of rollers, and a second shaft extending from a second roller of the set of rollers, the first shaft and the second shaft coupled with a spring to facilitate data acquisition about a diameter of the tubular;

positioning the hydraulic workover unit on a well system that includes a wellbore; and performing an automated tripping operation with respect to the wellbore using the subsystem, the automated tripping operation involving performing multi-dimensional data acquisition about the subsystem using the set of encoders to determine linear displacement and multi-dimensional information of the tubular for controlling the automated tripping operation.

14. The method of claim 13, wherein the first roller of the set of rollers is located on a first side of the tubular, wherein the second roller of the set of rollers is located on a second side of the tubular opposite the first side, and wherein performing the automated tripping operation comprises using a first encoder of the set of encoders to acquire data about first rotation of the first roller or second rotation of the second roller to determine a magnitude and direction of movement of the tubular.

15. The method of claim 14, wherein performing the automated tripping operation comprises:

using the first encoder of the set of encoders to determine a first linear displacement of the tubular; and using a second encoder of the set of encoders to determine a second linear displacement of the tubular, wherein the first linear displacement and the second linear displacement are used to determine an ovality of the tubular.

16. The method of claim 14, wherein the first shaft and the second shaft overlap at a first location, wherein a second encoder of the set of encoders is located at the first location to track an angle between the first shaft and the second shaft, and wherein the angle between the first shaft and the second shaft is proportional to the diameter of the tubular.

17. The method of claim 14, wherein the subsystem comprises a set of followers, wherein a first follower of the set of followers extends out of the first roller in a first direction, wherein a second follower of the set of followers extends out of the second roller in a second direction that is approximately the same as the first direction, and wherein performing the automated tripping operation comprises linearly translating the set of followers in a third direction approximately parallel to the first direction and the second direction independent of rotational motion of the set of followers.

18. The method of claim 17, wherein the subsystem comprises a set of spiraled shafts, wherein the set of encoders includes a second encoder and a third encoder, wherein the second encoder is located on a first end of a first spiraled shaft of the set of spiraled shafts, wherein the third encoder is located on a first end of a second spiraled shaft of the set of spiraled shafts, and wherein performing the automated tripping operation comprises:

performing a first data acquisition by the second encoder about a diameter of the tubular; and performing a second data acquisition by the third encoder about the diameter of the tubular.

* * * * *